United States Patent [19]

Lauener

[11] Patent Number: 4,785,873

[45] Date of Patent: Nov. 22, 1988

[54] SEALING BETWEEN A CASTING NOZZLE AND AT LEAST ONE CONTINUOUS TRAVELING CASTING BELT

[75] Inventor: Wilhelm F. Lauener, Gerlafingen, Switzerland

[73] Assignee: Larex AG, Recherswill, Switzerland

[21] Appl. No.: 19,204

[22] Filed: Feb. 26, 1987

[30] Foreign Application Priority Data

Mar. 10, 1986 [CH] Switzerland ..... 972/86

[51] Int. Cl.[4] ..... B22D 11/06

[52] U.S. Cl. ..... 164/481; 164/432; 164/439; 164/440; 164/443; 164/485; 164/488; 164/490

[58] Field of Search ..... 164/432, 430, 431, 433, 164/434, 479, 481, 482, 485, 488, 490, 435, 443, 437, 439, 440

[56] References Cited

U.S. PATENT DOCUMENTS

| | | | |
|---|---|---|---|
| 3,429,363 | 2/1969 | Hazelett et al. . | |
| 3,431,971 | 3/1969 | Gyongyos | 164/434 |
| 3,933,193 | 1/1976 | Baker et al. | 164/432 |
| 3,937,270 | 2/1976 | Hazelett et al. | 164/481 |

FOREIGN PATENT DOCUMENTS

| | | | |
|---|---|---|---|
| 0045365 | 2/1982 | European Pat. Off. | 164/432 |
| 0148384 | 7/1985 | European Pat. Off. . | |
| 1508876 | 11/1969 | Fed. Rep. of Germany . | |
| 1758957 | 4/1971 | Fed. Rep. of Germany . | |
| 1418754 | 10/1965 | France . | |
| 51-14823 | 2/1976 | Japan | 164/434 |
| 58-20356 | 2/1983 | Japan | 164/431 |
| 59-153552 | 9/1984 | Japan | 164/432 |
| 423109 | 4/1967 | Switzerland . | |
| 508433 | 7/1971 | Switzerland . | |

*Primary Examiner*—Nicholas P. Godici
*Assistant Examiner*—J. Reed Batten, Jr.
*Attorney, Agent, or Firm*—Marks Murase & White

[57] ABSTRACT

Prior to reaching the nozzle's exit, the belt is pressed from outward against the nozzle by means of a rail supported by springs whereby the mould is reliably sealed off under all working conditions. Pressing the belt against the nozzle can also be achieved by means of pistons or the direct hydrostatic and/or hydrodynamic effect of the coolant from the outside or through various combined measures. In order to reduce friction and wear, the nozzle in the area of contact with one belt can be provided with a wear-resistant coating or wear-resistant inserts. This sealing method enables a casting process with high metallostatic pressure, consequently resulting in a high quality product.

25 Claims, 3 Drawing Sheets

SEALING BETWEEN A CASTING NOZZLE AND AT LEAST ONE CONTINUOUS TRAVELING CASTING BELT

BACKGROUND OF THE INVENTION

The present invention relates to a sealing between the nozzle and the mould of a continuous casting apparatus featuring at least one travelling flexible belt.

A familiar continuous casting apparatus of this type is characterized by a so called casting wheel which features a rim that is internally cooled by a liquid (U.S. Pat. No. 3,429,363). Along its circumference, the rim features a cavity corresponding to the dimensions of the desired casting and so forming three sides of the mould. The fourth side is formed by a metal belt touching the edges to the cavity along part of the wheel's circumference thereby creating a closed mould around the outside of the cross-section to be cast.

The belt is usually endless and runs on guide rolls which permit adjustment of the required tension. Thus, for a predetermined wheel diameter, the belt and casting wheel collectively form a mould of the desired length. Along the full length of the mould the outward side of the belt is intensively cooled by a liquid. When the casting wheel, by means of a drive, is caused to rotate, the belt moves along with it, thereby creating a mould that moves along with the cast material.

Another so called twin belt continuous casting apparatus is characterized by a pair of moving belts forming the mould in between.

Usually rotating and endless belts are used which run over appropriate guide rolls also used to stretch the belts. If a casting process allows for interruptions, it is also possible, instead of belts, to use strips of appropriate length running off a coil, being recoiled after passing the casting zone or serving as a covering layer for the cast material as it is moved on for further processing (DE Pat. No. 1 508 876).

It is known to build the side dams of the mould as travelling endless chains consisting of individual blocks which are tightly connected to each other by means of flexible joints. These blocks consist of metal or ceramic material and fit precisely into the space between the two belts, the width of the mould being determined by the space between the side dams located on both sides between the belts.

The path of the moving side dams can be positioned in a plane parallel or perpendicular to the axes of the guide rolls supporting the belts. The belts along with the side dams are usually activated by means of a drive connected to one of the guide rolls of the belts, whereby a mould moving along with the cast material is realized. It is also known practice to use an additional drive for the side dams.

The heat transferring from the cast material to the belt is removed through intense cooling of the belt's back side by means of a liquid. For a casting apparatus of the first type as well as for one of the second type, feeding systems are applied which direct the liquid metal into the mould. As a result of the heat drain in the mould, a completely or partially solidified casting—depending on the material being cast—will exit from the mould. So called open or closed feeding systems are in use. In an open system the liquid metal reaches the mould after flowing through an appropriate channel, the flow being controlled by familiar means. If the cast material has to meet high quality requirements, only a closed system can be used. In this case the liquid metal is fed into the mould by means of a nozzle which reaches into the mould at the same time sealing it off towards the entry side.

The material of the nozzle is chosen according to the properties of the liquid metal being cast. The requirements to be met concern temperature, heat-shock upon the first contact between nozzle and liquid metal, heat conductivity, erosion, chemical reactions with the liquid metal, formability and economy. By nature of the demands ceramic materials of various kinds, according to the specific requirements, are predominant. Nozzles being used consist e.g. of compressed and sintered ceramic-fibres based on silicon dioxide and alumina, impregnated with binder and filling material or of aluminum titanate, graphite, boron nitride, quartz etc.

Due to changes in dimension of the nozzle and the mould as a result of dilatation and heat-distortion, there is usually a certain clearance between these elements in order to avoid any jamming of the nozzle which could damage this vital part and cause serious problems for the casting process. This clearance usually amounts to approximately 0.1 to 0.5 mm. Due to this intended clearance, the metallostatic pressure in the liquid metal at the exit of the nozzle must be regulated with tight limits. Sealing gains rising significance with increasing pressure and/or decreasing viscosity or surface tension of the liquid metal. It is known practice to enhance the sealing by giving the nozzle an appropriate shape. Despite the measures described the danger of a backflow and its consequences remains.

SUMMARY OF THE INVENTION

The goal of the present invention is to assure a complete sealing off of the mould across its full width between the nozzle and the belt or belts in a single belt or twin belt casting apparatus. This goal is achieved by the fact that the belt by applying its elastic quality is pressed against the nozzle from which the mould along its width is thus sealed. The applied force is thereby adjusted so that the casting belt does not lose contact with the nozzle despite the metallostatic pressure in the liquid metal at the exit of the nozzle.

The approximate value of the force directed from outwards towards the nozzle and against the belt amounts to:

$$F = a*H*Ga*B \quad [N] \qquad (I)$$

wherein

B = casting width [m]

a = 0.10 to 0.25 [Nm/kg]

H = difference in level [m]

Ga = specific mass of the material being cast [kg/m$^3$]

The difference in level corresponds to the difference between the level in the tundish and that of the lower belt at the exit of the nozzle.

BRIEF DESCRIPTION OF THE DRAWINGS

The invention will now be explained more fully with reference to possible designs as shown in the drawings.

DETAILED DESCRIPTION OF THE INVENTION

Figure 1:
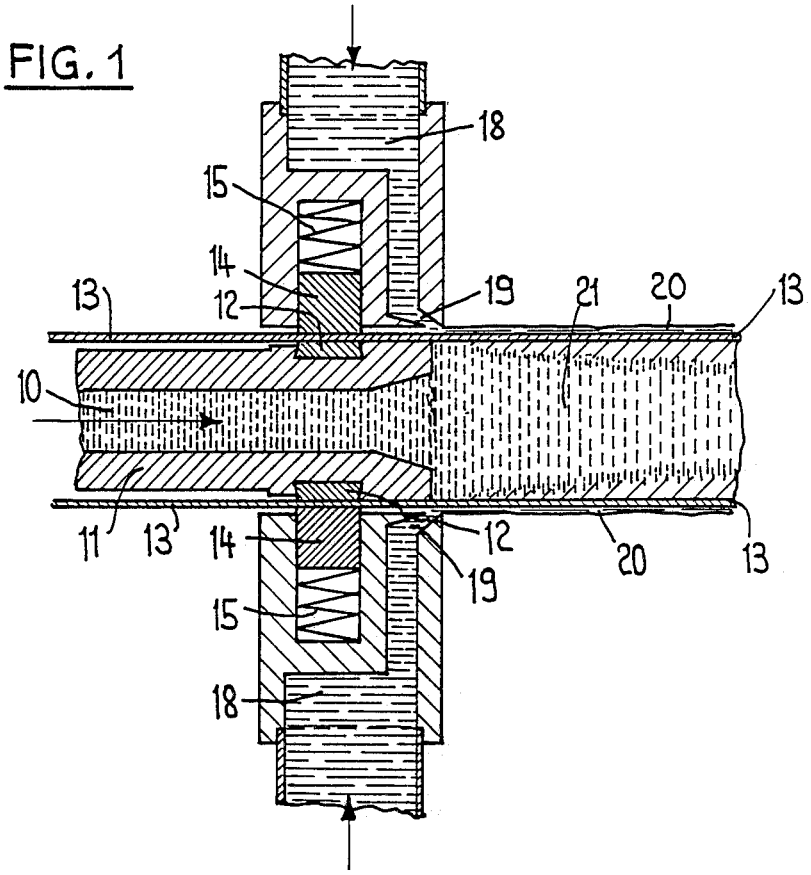
FIG. 1 shows a longitudinal section of a first design example, the belts being elastically pressed against the nozzle.

FIG. 1 demonstrates a first solution for a sealing between nozzle and belt, the example referring to a horizontal casting apparatus featuring two belts. The liquid metal 10 flows through the nozzle 11 into the mould 21 which is bordered at the top and at the bottom by the belts 13. In order to avoid overheating the belts 13, a liquid coolant is directed from pressure chambers 18 with high velocity through the coolant jets 19 onto the back side of the belts. In order to achieve a gap free sealing of the mould by means of the nozzle 11, the belts 13 are pressed against the mouthpiece of the nozzle 11 using a rail 14 under a yielding load resulting from the supporting springs 15.

It is advantageous to have the rail extend over the full casting width of the nozzle. The rail can be one single part or composed of several separate parts of arbitrary length. The material may be synthetic, metal or ceramic. Depending upon the dimensions of the nozzle the rail will preferably be from 8 to 12 mm wide and have a weight of similar magnitude.

Figure 3:
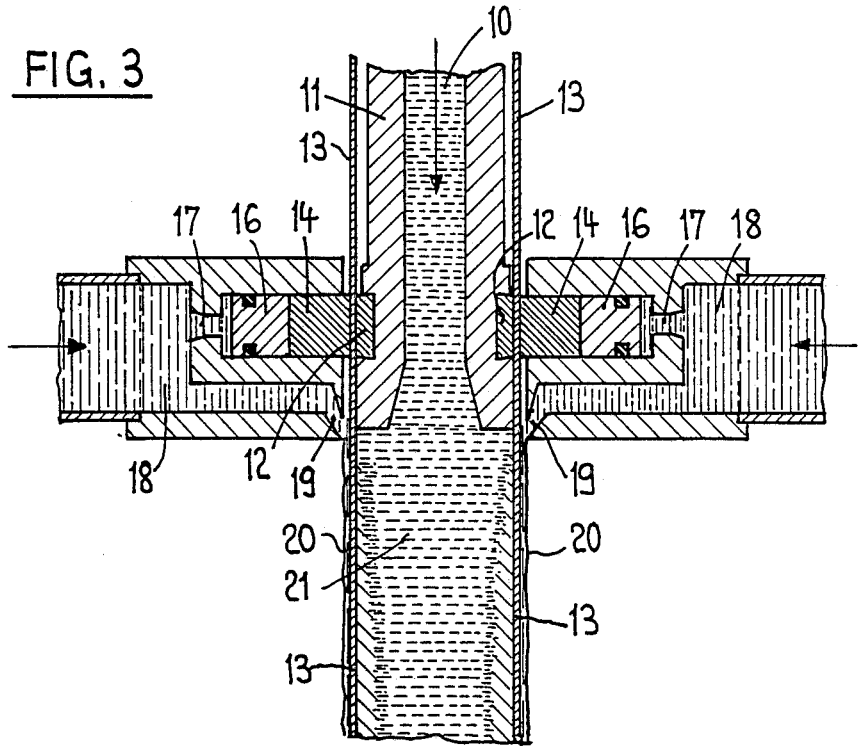
FIGS. 3 to 6 show further examples of possible designs.

According to FIG. 3 the rail 14 is hydraulically loaded, with pistons 16 being directly influenced by the coolant under pressure as it flows through the opening 17 directly coming from the pressure chamber 18. FIG. 3 shows a vertically positioned casting apparatus.

It is, however, also possible to load the pistons 16 hydraulically or pneumatically by means of a separate pressure system.

A further possibility is to bypass the pistons altogether and to let the pressure liquid take direct effect upon the rail 14. This solution of course requires corresponding sealing measures.

Figure 2:
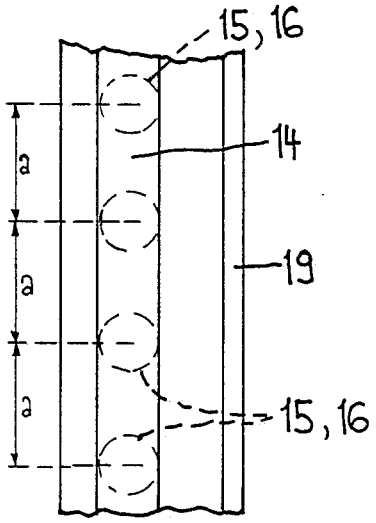
FIG. 2 shows a partial view of the inside of a sealing and cooling unit.

If springs (15, FIG. 1) or pistons (16, FIG. 3) are used, they are positioned at an appropriate distance (a) from each other (FIG. 2) and so dimensioned as to assure contact between the belt and the nozzle despite the metallostatic pressure at the exit of the nozzle.

Figure 4:
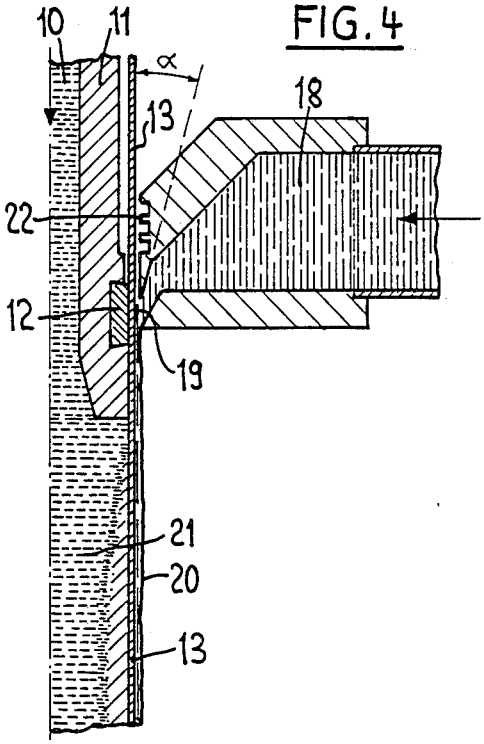

A further possibility to press a belt against the nozzle is to guide the coolant with high velocity and at the angle $\alpha$ through the jet 19 directly onto the belt. FIG. 4 shows this kind of arrangement, vertically oriented. Redirecting the mass flow of the coolant by the angle $\alpha$ results in a force component which takes effect upon the belt. The leakage of coolant in the backward direction can be kept within tolerable limits by means of a labyrinth gland 22 whereby the leakage of coolant is collected within the casing of the apparatus and can be directed back into the cooling system.

The coolant flow 20 emanating with high velocity from the coolant nozzle covers the whole back surface of the belt thereby creating the corresponding cooling effect. Guidance and support elements of the belt can be realized with familiar means and are not shown.

Figure 5:
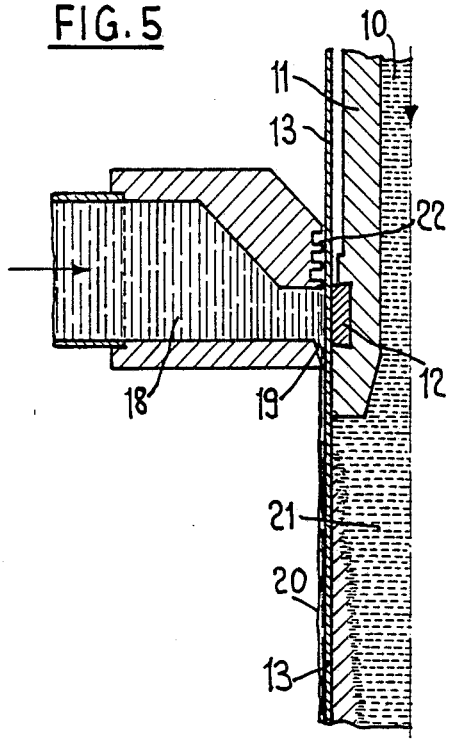

A further version according to FIG. 5 is characterized by the fact that the prevailing static pressure of the coolant in the pressure chamber 18 takes effect upon the belt 13 and presses it against the nozzle 11. The coolant thereby flows onto the belt 13 directly from the pressure chamber 18, through the adjacent coolant nozzle 19. The kinetic energy of the coolant being exhausted at a certain distance from the exit of the coolant nozzle, the coolant can be replaced at regular distances and by familiar means.

Figure 6:
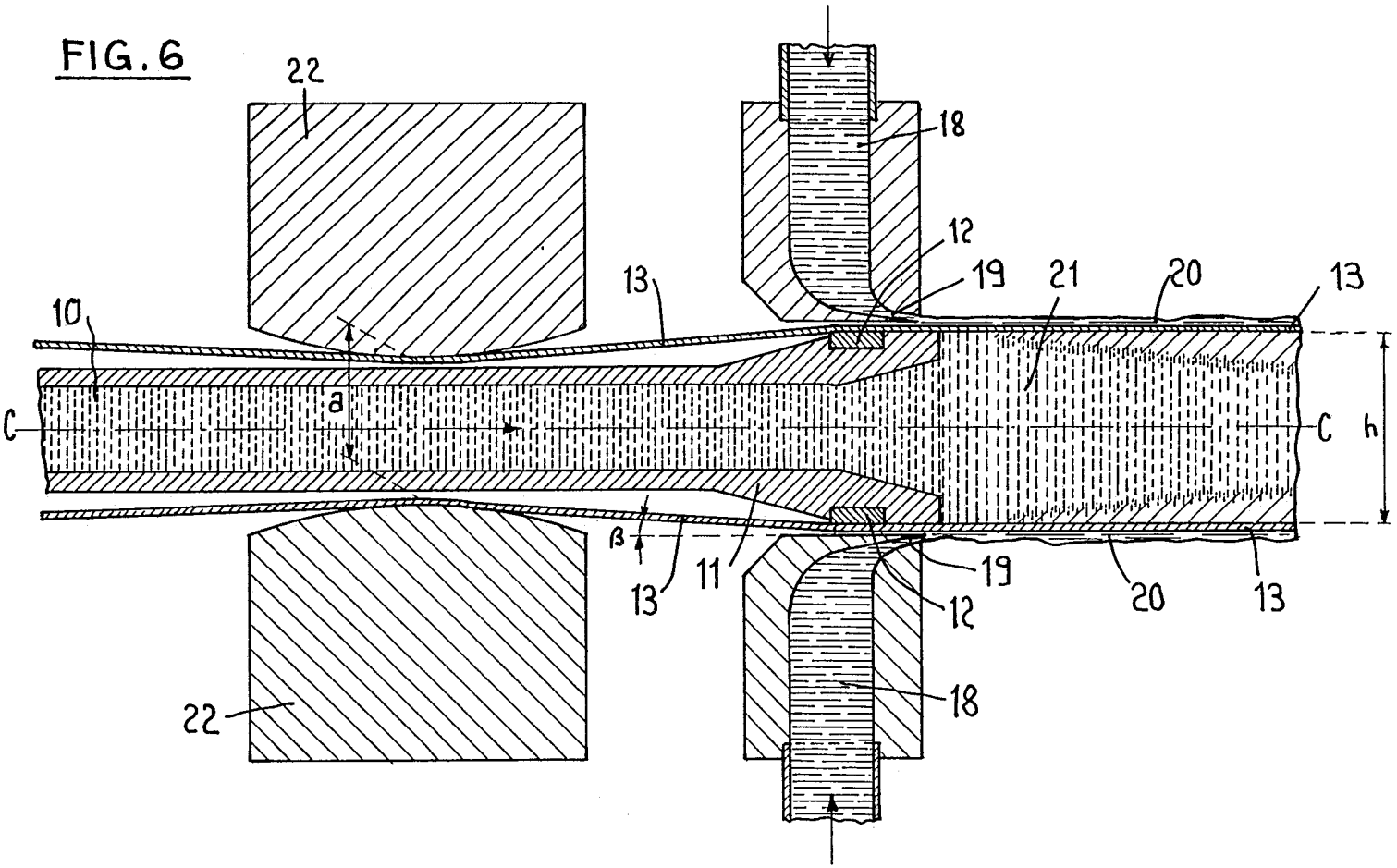

In the case of a twin belt casting apparatus, pressing the belt against the nozzle can also be achieved by guiding the belt in such a way as to have it diverge from the center line of the nozzle in the area prior to the nozzle's exit, then upon reaching the mouthpiece of the nozzle to be redirected into the casting direction, which redirecting causes a force to act upon the nozzle due to the tension in the belt. FIG. 6 illustrates a solution of this kind, both belts 13 being directed by guide elements 22 positioned at a distance a that is smaller than the height h of the nozzle. The result is a diverging direction of the belt 13 with respect to the center line C—C of the nozzle 11. A force F directed towards the nozzle results due to the tension in the belt.

In place of fixed elements 22 it is also possible to apply guide rolls.

The cross section of a belt being A, the prevailing tension in the belt being $\sigma$, the angle of redirection on the nozzle being $\beta$ and the casting width being B, the force F can be calculated as follows:

$$F = A^*\sigma^* \sin \beta \qquad \text{(I)}$$

In the case of a belt using 0.7 mm thick and 1000 mm wide, the tension in circumferential direction amounting to $\sigma = 25\ N/mm^2$, an angle of $\beta = 1$ deg would result in a force upon the nozzle of $$F = 1000^*0.7^*25^* \sin (1) = 305N$$

With reference to a practical application, it is therefore possible according to equation I to seal off the mould in view of a metallostatic pressure corresponding to a column of liquid metal in the range of approximately 700 mm of aluminum or 250 mm of steel.

All the solutions described above allow for adjustment of the decisive parameters in order to regulate the force pressing the belt against the nozzle according to the prevailing metallostatic pressure at the exit of the nozzle.

The principle according to the invention is not bound to the methods described above of directing the coolant onto the belt. It is possible to apply the principle of sealing off the mould between belt and nozzle in connection with other cooling methods as well.

A different, applicable cooling method would be e.g. spraying by means of spray-jets positioned at small distances from each other or the application of so-called guiding faces (e.g. according to EP No. 0 148 384).

The application of the invention as presented involves a certain amount of friction between the belt and the nozzle. It is therefore advantageous to apply a wear-resistant coating in the zone of contact on the mouthpiece of the nozzle. This can be accomplished by familiar methods, using the flame-spray or plasma-spray technique and placing a coating of alumina approx. 0.1 to 0.2 mm thick.

A further possibility is to place wear-resistant inserts 12 on the outside of the mouthpiece of the nozzle. For this purpose materials such as alumina, silicon carbide or silicon nitride, metal carbide and others are well suited. By applying one of the methods mentioned it is possible to prevent an early wear-out of the nozzle.

The Swiss patent specification No. 508 433 describes a nozzle featuring inserts of self-lubricating material in some distance from the nozzle's exit. The inserts serve the purpose of guiding the mouthpiece between the rigid casting blocks of a block caster in such a manner as to prevent any contact between the casting blocks and the nozzle's mouthpiece. A clearance of 0.2 to 0.3 mm between the nozzle and the casting block is even claimed. In this case it is known by experience that a sealing effect can only be achieved for a low metallostatic pressure, amounting at the most to a column of 20 to 30 mm of liquid aluminum.

The respective invention presented differs from this design and function first inasmuch as the inserts are not protruding from the body of the mouthpiece of the nozzle and second, that the inserts are as close as possible to the exit end of the nozzle, and third, that the inserts are composed of a hard and wear-resistant material, thereby increasing the working time of the nozzle in view of the fact that the belts are pressed against the nozzle in order to guarantee complete sealing off of the mould even in the event of increased metallostatic pressure due to casting in upward direction.

As previously indicated, two or more of the methods mentioned can be applied in combination. This is shown in FIG. 1 and FIG. 3 as the pressing force achieved by means of springs or pistons is increased by the effect of a certain hydrostatic and hydrodynamic pressure resulting from the coolant. This combined effect however can yet be intensified.

Contrary to the usual and known methods, the sealing-off according to the invention allows for cooling the belts after they have passed the point of contact with the nozzle (11). According to the design as shown in FIG. 1 and FIG. 3 it is possible to commence cooling of the belts at the nozzle's exit. This is advantageous in case the belts are pre-heated before entering into the casting zone in order to eliminate wrinkling and other undesired deformations of the belts because of strong temperature-based dilatation.

As already shown, the orientation of the casting direction respectively of the casting process is arbitrary. In addition to the horizontal or vertical, orientations shown, the casting direction may be oriented at an arbitrary angle. The method of sealing-off according to the invention always has the advantage that with a closed feeding system for the liquid metal, higher metallostatic pressures are allowed as a result of a vertical arrangement, be it that in case of a horizontal or upward casting direction the level in the tundish is higher than what was common up to now. The vertical arrangement furthermore entails advantages with respect to the symmetrical conditions for cooling, as well as for the casting and solidification process in general. The increased casting pressure causes a better flow of the liquid metal into the zone of solidification, the result being a high quality structure of the cast strip.

Considering a twin belt casting apparatus, it is possible to have only one belt pressed against the nozzle whereas the other belt is guided by means of a rigid support. The one belt being pushed against the nozzle will cause the nozzle to press against the rigidly supported belt on the other side, thus creating the desired sealing-off on both sides of the nozzle.

So far it has been assumed that one or two belts are pressed from outward against the nozzle. It is however feasible to provide, on the outside of the nozzle, a sufficient number of heat-resistant bars which are elastically or by means of metallostatic pressure pushed outwards against the belts which in this area are outwardly supported by rigid supports realized e.g. by coolant nozzles. It is also possible to design a flexible exit of the nozzle itself and to achieve a sealing effect by pressing the edges of the nozzle's mouthpiece against the belts by means of the internal metallostatic pressure.

What I claim:

1. A method of sealing a mould for a twin belt continuous casting apparatus comprising the steps of:

providing a pair of casting belts, each having a casting width, in contacting relation with a casting nozzle so as to form a mould space at an exit of said casting nozzle;

providing a pair of rail means for applying pressure along an entire extent of each of said casting widths, respectively; and applying a yielding load to each of said rail means, so as to induce a pressure sufficient to achieve a gap free seal between said casting nozzle and each of said casting belts.

2. The method according to claim 1, wherein each of said rail means is an elastically loaded rail adapted to press against one of said casting belts.

3. The method according to claim 1, wherein said yielding load is a pneumatically driven load.

4. The method according to claim 1, further comprising the step of commencing cooling of said casting belts at an exit of the casting nozzle.

5. The method according to claim 1, wherein said yielding load is a hydraulically driven load.

6. The method according to claim 1, further comprising the step of:

directing pressurized fluid against an entire extent of said first and second casting widths, respectively, said pressurized fluid being at a pressure sufficient to achieve a gap free seal between said casting nozzle and each of said casting belts.

7. The method according to claim 1, further comprising the step of providing a wear-resistant coating on portions of said casting nozzle which are in contacting relation with said casting belts.

8. The method according to claim 1, further comprising the step of providing wear-resistant inserts between said casting nozzle and said casting belts.

9. A method of sealing a mould for a continuous casting apparatus comprising the steps of:

providing a casting belt, having a casting width, with a casting nozzle, having a mouthpiece, so as to form a mould space at an exit of said casting nozzle;

guiding said casting belt in a substantially straight direction over the mouthpiece of said casting nozzle; and applying a uniformly distributed pressure along an entire extent of said casting belt casting width, said pressure being sufficient to achieve a gap free seal between said casting nozzle and said casting belt.

10. The method according to claim 9, wherein said step of applying a uniformly distributed pressure comprises the steps of:

providing a rail means for applying pressure along an entire extent of said casting width; and applying a yielding load to said rail means, so as to induce a pressure sufficient to achieve a gap free seal between said casting nozzle and said casting belt.

11. The method according to claim 10, wherein said rail means is an elastically loaded rail adapted to press against said casting belt.

12. The method according to claim 10, wherein said yielding load is a pneumatically driven load.

13. The method according to claim 10, wherein said yielding load is a hydraulically driven load.

14. The method according to claim 9, wherein the step of applying a uniformly distributed pressure comprises directing pressurized fluid against an entire extent of said casting width, said pressurized fluid being at a pressure sufficient to achieve a gap free seal between said casting nozzle and said casting belt.

15. A method of sealing a mould for a twin belt continuous casting apparatus comprising the steps of:

providing a first and a second casting belt having first and second casting widths, respectively, with a casting nozzle so as to form a mould space at an exit of said casting nozzle;

providing a rail means for applying pressure along an entire extent of said first casting width of said first casting belt;

providing a support means for supporting said second casting belt;

applying a yielding load to said rail means for inducing a pressure sufficient to achieve a gap free seal between said casting nozzle and each of said casting belts.

16. The method according to claim 15, wherein said yielding load is a hydraulically driven load.

17. The method of claim 15, further comprising the step of directing pressurized fluid against an entire extent of said first casting width, said pressurized fluid being at a pressure sufficient to achieve a gap free seal between said casting nozzle and each of said casting belts.

18. The method according to claim 15, further comprising the step of providing a wear-resistant coating on portions of said casting nozzle which are in contacting relation with said casting belts.

19. The method according to claim 15, further comprising the step of providing wear-resistant inserts between said casting nozzle and said casting belts.

20. A method of sealing a mould for a twin belt continuous casting apparatus comprising the steps of:

providing a pair of casting belts, each having a casting width, in contacting relation with a casting nozzle so as to form a mould space at an exit of said casting nozzle;

disposing a pair of pressure chambers adjacent said pair of casting belts, respectively, each pressure chamber extending across one of said casting widths and having an opening adjacent one of said casting belts;

directing pressurized fluid into each of said pressure chambers so as to apply hydrostatic pressure against an entire extent of each of said casting widths, respectively, said pressurized fluid being at a pressure sufficient to achieve a gap free seal between said casting nozzle and each of said casting belts.

21. The method according to claim 20, wherein said belts travel along a liquid metal flow path prior to engaging said casting nozzle, further comprising the steps of:

positioning said belts at a point on said liquid metal flow path such that they are displaced by a distance less than the width of said casting nozzle, whereby a tension force having a component directed toward said casting nozzle is induced in said belts.

22. A continuous casting sealing apparatus comprising:

a casting nozzle means for providing molten metal;

a pair of continuous casting belts, each having a casting belt width, positioned in contact with said casting nozzle means so as to form a mould space for receiving molten metal emanating from said casting nozzle means;

a pair of rail means for applying pressure along an entire extent of said casting belt widths;

a yielding load means for selectively applying pressure to each of said rail means.

23. The continuous casting apparatus according to claim 22, wherein said rail means are comprised of synthetic material.

24. The apparatus according to claim 22, wherein said yielding load means is a hydraulically driven load.

25. The apparatus according to claim 22, further comprising a means for directing pressurized fluid against an entire extent of each of said casting belts, said pressurized fluid being at a pressure sufficient to achieve a gap free seal between said casting nozzle means and each of said casting belts.

* * * * *